US005341668A

United States Patent [19]

Mack et al.

[11] Patent Number: 5,341,668

[45] Date of Patent: Aug. 30, 1994

[54] METHOD OF FORMING A VESSEL POURING SPOUT

[75] Inventors: Alfred N. Mack; Stephen L. Tobey, both of Corning, N.Y.

[73] Assignee: Corning Incorporated, Corning, N.Y.

[21] Appl. No.: 998,548

[22] Filed: Dec. 30, 1992

[51] Int. Cl.[5] ..... B21D 51/42

[52] U.S. Cl. ..... 72/379.4; 413/22; 222/572

[58] Field of Search ..... 72/316, 322, 348, 379.4; 413/1, 22, 53; 220/912; 222/465.1, 566, 572, 189

[56] References Cited

U.S. PATENT DOCUMENTS

| | | | |
|---|---|---|---|
| 1,298,801 | 4/1919 | Serio | 72/379.4 |
| 1,384,786 | 7/1921 | Thompson | 222/572 |
| 3,144,974 | 8/1964 | Eichner et al. | 229/3.5 |
| 3,263,637 | 8/1966 | Cox | 113/120 |
| 3,496,896 | 2/1970 | Smith | 113/120 |
| 3,580,041 | 5/1971 | Tilly et al. | 72/348 |
| 4,452,063 | 6/1984 | Sebastiani et al. | 72/356 |
| 4,606,214 | 8/1986 | Miyazaki | 72/318 |
| 4,890,471 | 1/1990 | Ito | 72/348 |
| 5,068,964 | 12/1991 | Yabuno et al. | 29/892.3 |
| 5,135,128 | 8/1992 | Kuhn | 220/912 |

FOREIGN PATENT DOCUMENTS

| | | | |
|---|---|---|---|
| 217346 | 5/1968 | U.S.S.R. | 72/316 |
| 428900 | 9/1934 | United Kingdom | 72/322 |
| 700357 | 12/1953 | United Kingdom | 222/572 |
| 1329363 | 9/1973 | United Kingdom | 72/348 |

*Primary Examiner*—Daniel C. Crane
*Attorney, Agent, or Firm*—T. M. Schaeberle

[57] ABSTRACT

A method for forming a constant geometry and non-turbulent stream inducing pouring spout in the rim portion of an annular side-walled vessel. The method comprises the steps of: a) positioning the vessel within a clamp possessing a groove whose centerline forms a 90° angle with the annular side wall of the vessel when the clamp is in place; b) placing inside the vessel a center plug possessing a radially extending groove whose centerline forms a 90° angle with the annular side wall when the center plug is in place; c) aligning the centerlines of the grooves of the clamp and the center plug to form a straight line travel path; d) placing a pour spout former in the center plug portion's groove and causing the former to travel along the travel path and into contact with the rim portion of the vessel; and, e) further causing the former to travel along the travel path to yieldably deform the rim portion of the annular wall into the desired shape pouring spout. The actual deformation of the rim takes place in three stages. The first stage and third stages involve deforming the rim portion by the former in an outward and upward direction and an outward and downward direction, respectively, while the second stage involves deforming the rim portion in only an outward direction.

5 Claims, 7 Drawing Sheets

METHOD OF FORMING A VESSEL POURING SPOUT

RELATED APPLICATION

U.S. Ser. No. 913,199 filed on Jul. 15, 1992 by R. W. Greger under the title Vessel with Pouring Spout Inducing Constant Geometry, Non-Turbulent Stream and Vented Closure for Same is directed toward a vessel having pouring spouts adapted to allow the transferring of liquids and other materials contained within the vessel.

BACKGROUND OF THE INVENTION

This invention relates generally to a method for forming vessels having pouring spouts, and is a particularly suitable method for forming cookware having pouring spouts adapted to allow the transferring of liquids, sauces, and other foods contained within the cookware.

Because the disclosed invention is a particularly suitable method for cookware, the invention will be disclosed in relation to that exemplary application. However, it should be noted that the invention is not specifically limited to that application, as it is an applicable method for vessels other than those intended for kitchen or domestic use.

Cooking vessels used for heating and cooking liquids of varying viscosities containing a wide range of relatively solid food particles suspended therein are in daily use throughout the world. Upon completion of heating the contents of the vessel, it is frequently desirable to precisely control the rate and direction of flow of the contents into another vessel for additional preparation, cooling, storing, serving, or disposal. Additionally, when cooking meat products wherein fat is rendered, or liquified fat or oil is used as a cooking medium, it is common to pour the excess fat or oil into another vessel for future use or disposal.

The prior art is replete with vessels having pour spouts to aid in the transferring of the contents of a first vessel into a second receiving vessel. However, prior art vessels share a common shortcoming in that when the contents are poured out of the first vessel, the resulting stream is not geometrically constant and tends to exit the vessel at varying rates. For example, the contents of the vessel would lap the outside of the vessel if the pouring rate was too slow, and conversely, if the pouring rate was too fast, the contents would exit the vessel in a non-uniform, waterfall-like geometry resulting in poor directional and flow rate control. Such stream characteristics resulted in undesired dripping, spillage, and possibly over filling the receiving vessel. The spillage and dripping occurring from the lack of control when pouring contents out of a vessel not only constitutes an inconvenience to the user, but in some extreme cases may provide a hazard to an inattentive user when transferring hot oil or fats.

Thus, there was need for vessels having a pouring spout that provides a uniform geometric flow pattern regardless of the particular pouring rate of the contents exiting the vessel.

Originally, the unique pour spout vessels were manufactured from aluminum, however, because of the success of the product a demand for similar products made of stainless steel was created. A forming problem was encountered immediately because the vessel pour spout shaping process conventionally utilized for stainless steel, i.e., straight pressing, caused too much downward force in the steel resulting buckling of the metal. A roller type process was investigated, but without success, because, this process again caused too much downward force and subsequent buckling of the stainless steel material. Therefore, a process for forming these unique pour spouts in stainless steel needed to be developed. It is this problem to which the invention disclosed herein is directed.

SUMMARY OF THE INVENTION

Hence, it is an objective of the present invention to provide a method for forming in a vessel of any material, including stainless steel, a pouring spout which provides for easy control of the direction and the rate of flow of the liquid being poured from the vessel. Furthermore, the pouring spout configuration is such that the liquid being poured retains an initially convex-sided V-shaped flow pattern that reforms into a generally round, non-turbulent stream, regardless of the flow rate of the liquid, or substance, being poured.

A further objective of the present invention is to provide a method for forming in a vessel of any material, including stainless steel, a pouring spout which prevents unwanted lapping of the liquid onto the exterior of the vessel while pouring from the vessel, and which prevents liquid from dripping from the spout after pouting has been completed.

In accordance with the above objectives a method for forming a constant geometry and non-turbulent stream inducing pouring spout in the rim portion of a annular side-walled vessel is disclosed. The method comprises the steps of:

a) positioning the vessel within a clamping means possessing a groove whose centerline forms a 90° angle with the annular side wall of the vessel when the clamping means is in place;
b) placing inside the vessel a center plug means possessing a radially extending groove whose centerline forms a 90° angle with the annular side wall when the center plug means is in place;
c) aligning the centerlines of the grooves of the clamping means and the center plug means to form a straight line travel path;
d) placing a pour spout forming means in the center plug portion's groove and causing the forming means to travel along the travel path and into contact with the rim portion of the vessel; and,
e) further causing the forming means to travel along the travel path to yieldably deform the rim portion of the annular wall into the desired shape pouting spout.

The actual deformation of the rim takes place in three stages. The first stage and third stages involve deforming the rim portion by the forming means in an outward and upward direction and an outward and downward direction, respectively, while the second stage involves deforming the rim portion in only an outward direction.

PRIOR ART

U.S. Pat. No. 3,580,041 (Tilly) discloses a method and apparatus for forming sheet material into containers. A punch and die arrangement includes supporting the forming portions of the die assembly by a pressurized fluid such as air so that these portions yieldably conform with precision to the punch surfaces during a forming operation.

U.S. Pat. No. 4,890,471 (Ito) describes a punch press method and apparatus for forming a CRT shadow mask. The method involves clamping the outer periphery of a blank and stretch or draw-forming the main spherical surface of the mask. After releasing, the method involves wipe-forming the skirt of the mask followed by a subsequent press-forming of a spherical border inward of the skirt. The apparatus is arranged such that a single downward stroke of press successively implements all of the forming steps.

U.S. Pat. No. 5,068,964 (Yabuno) discloses a precise method of making a poly-V grooved pulley flange from a circular flat plate of sheet metal of a predetermined thickness without causing buckling in the cold worked metal. The method involves pressing a central portion of the parent flat plate to form hub wall with a predetermined thickness thinner than that of the parent flat plate. The circular flat peripheral flange is drawn to form a cylindrical flange wall which then has formed in its exterior periphery a plurality of V-shaped grooves.

Although all of the references discussed above relate to forming metal into precise shapes without causing the metal to buckle, the instant invention, none suggest or teach the method disclosed herein. Specifically, none of the references teach or even suggest the combined use of a clamping, center plug and forming means as is used in the inventive deformation process.

A number of other U.S. patents related to metal working and deformation were studied as background art and for their possible relevance to patentability in connection with the preparation of this application, namely:

| | |
|---|---|
| 3,144,974 | Eichner |
| 3,263,637 | Cox |
| 3,496,896 | Smith |
| 4,452,063 | Sebastiani et al. |
| 4,606,214 | Miyazaki |

DETAILED DESCRIPTION OF THE INVENTION

Figure 1:
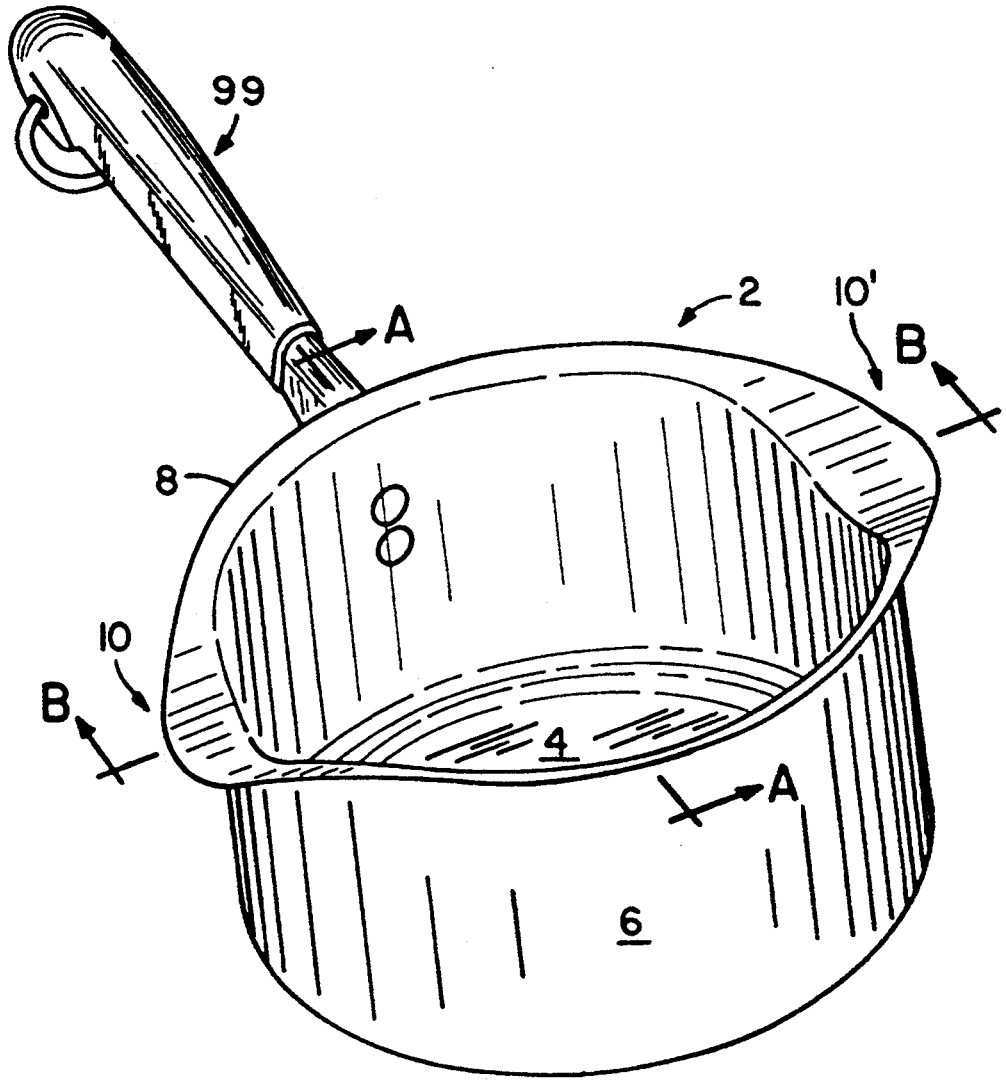
FIG. 1 is an upper perspective view of cookware incorporating a pair of opposing pouring spouts according to the preferred embodiment of the invention.
Figure 2:
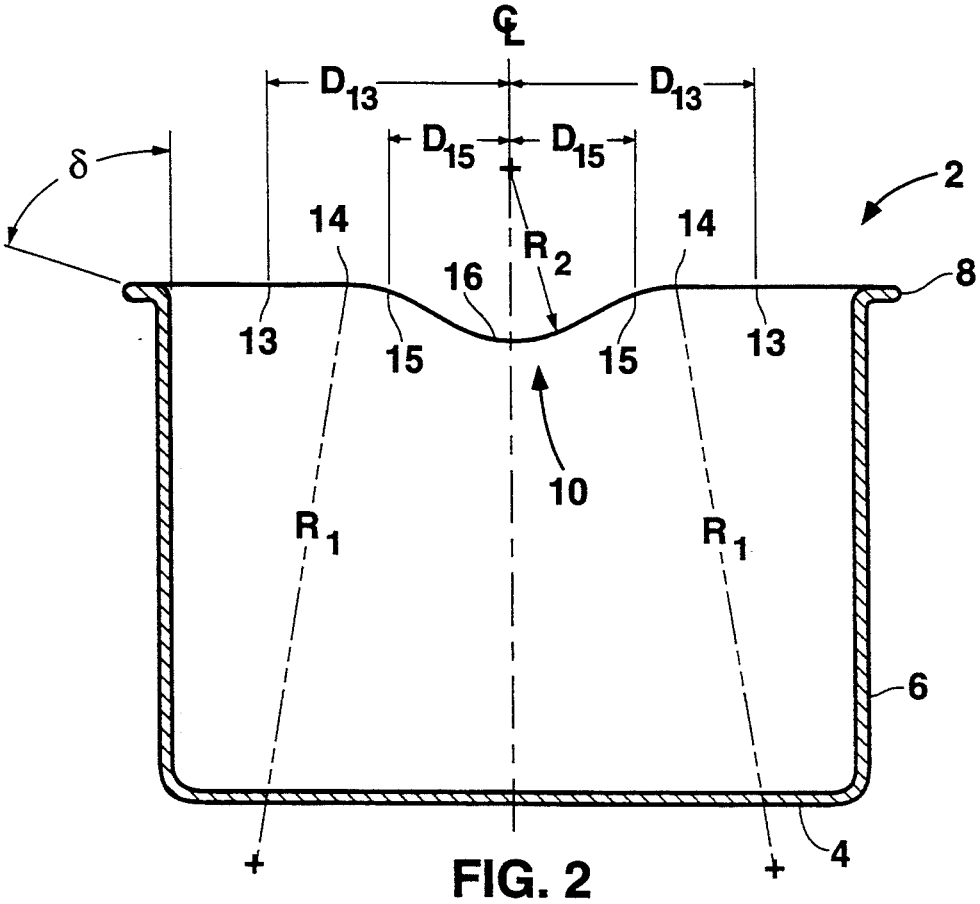
FIG. 2 is a sectional view of the cookware taken along section line A—A as shown in FIG. 1.
Figure 3:
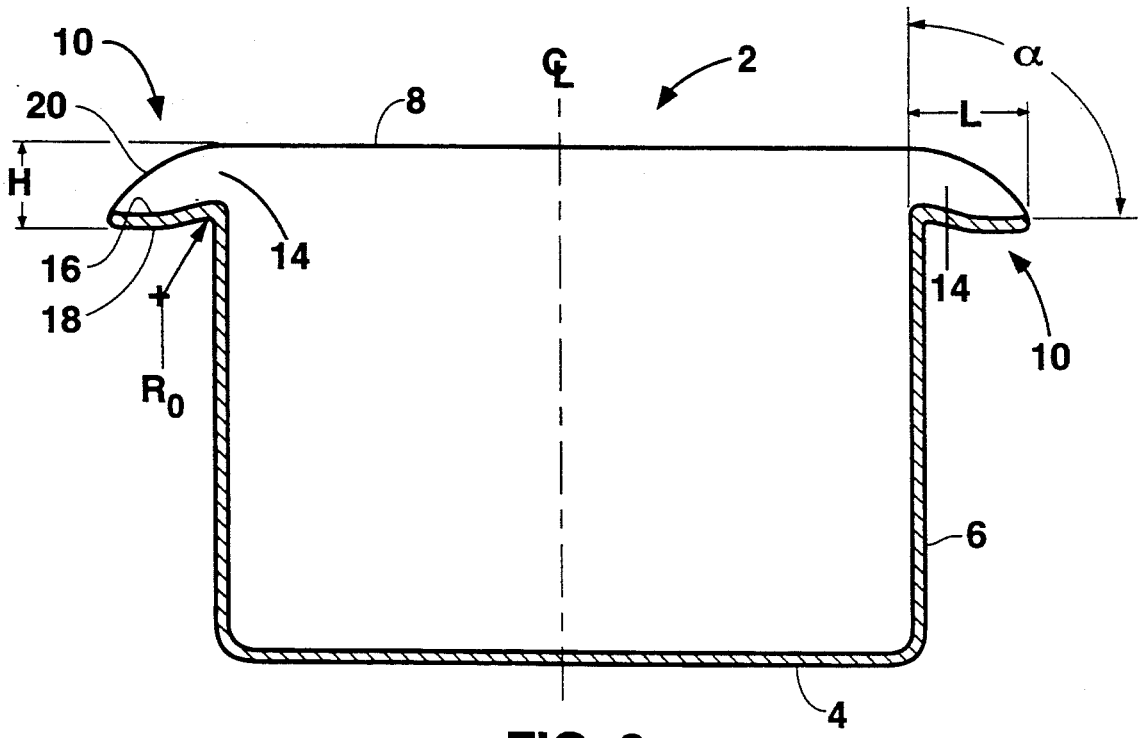
FIG. 3 is a sectional view of the cookware taken along section line B—B as shown in FIG. 1.

FIG. 1 shows a perspective view of a cooking vessel 2 commonly referred to as a saucepan. Cooking vessel 2 has a bottom 4 with an annular side wall 6 extending upward therefrom and terminating into rim portion 8. Vessel 2 is further provided with at least one pouring spout 10, and vessel 2 shown in the drawings includes an optional second pouring spout 10' located approximately 180° from spout 10. A handle 99 is attached to vessel 2 and located approximately 90° from each pouring spout. Vessel 2 having two pouring spouts, in lieu of one, is beneficial to users who prefer to have a choice of grasping handle 99 with the less dominant hand thereby resulting in the dominant hand being free to manipulate a utensil, such as a spoon or ladle, etc., while pouring from a selected spout. Alternatively, the user may grasp handle 99 with the dominant hand and pour from the opposite spout. Providing two pouring spouts, in lieu of one, is also of benefit to users who lack the use of a particular hand or arm as the vessel can be poured from the spout most suitable to that particular user. However, one such spout is sufficient to practice the disclosed invention. FIG. 1 includes sectional lines A—A and B—B of which sectional views taken along those lines are shown in FIGS. 2 and 3 respectively. Handle 99 is shown only in FIG. 1 and has been omitted from the remainder of the drawings.

Figure 4:
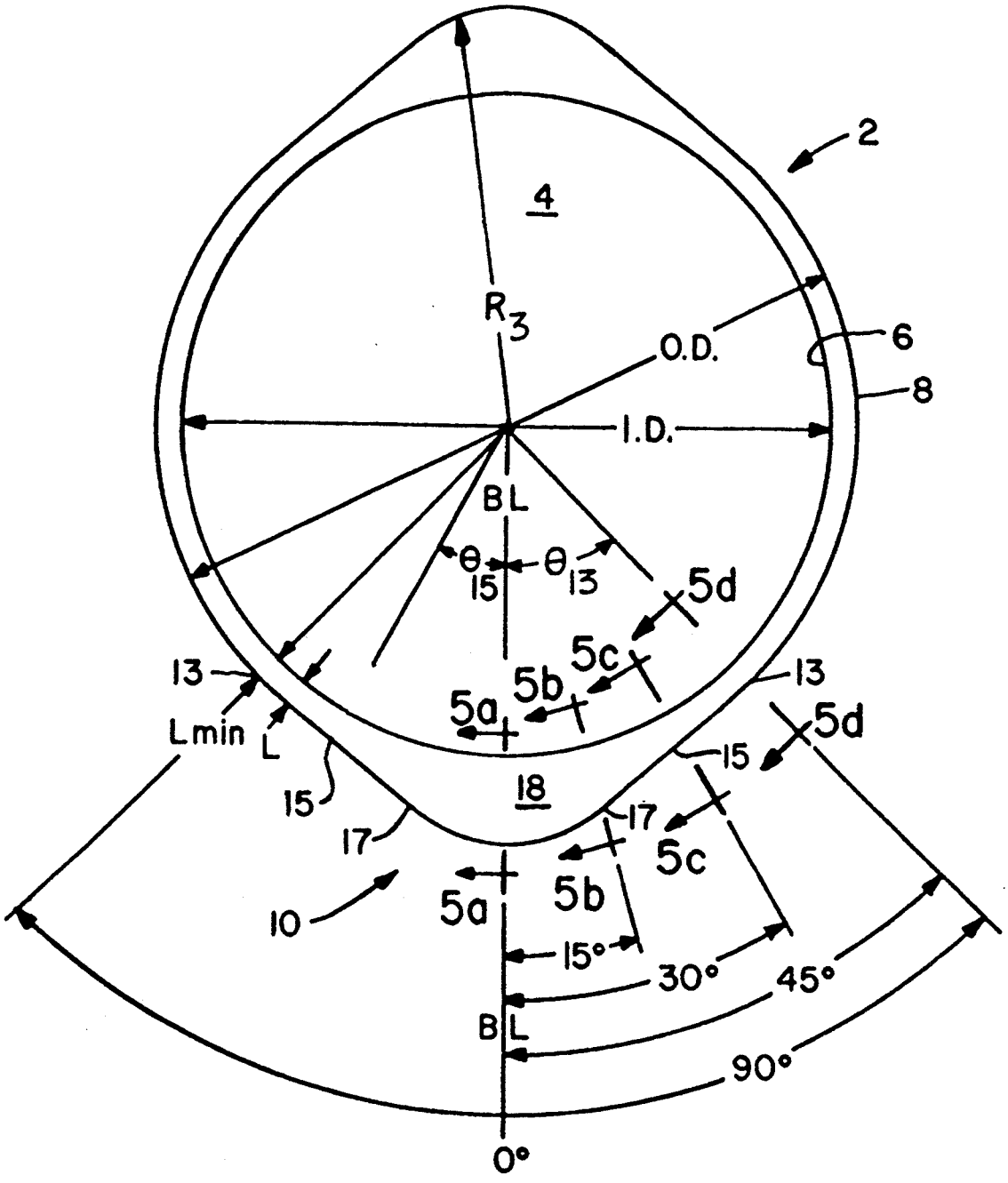
FIG. 4 is a top view of the cookware shown in FIG. 1.
Figures 5A, 5B, 5C, 5D:
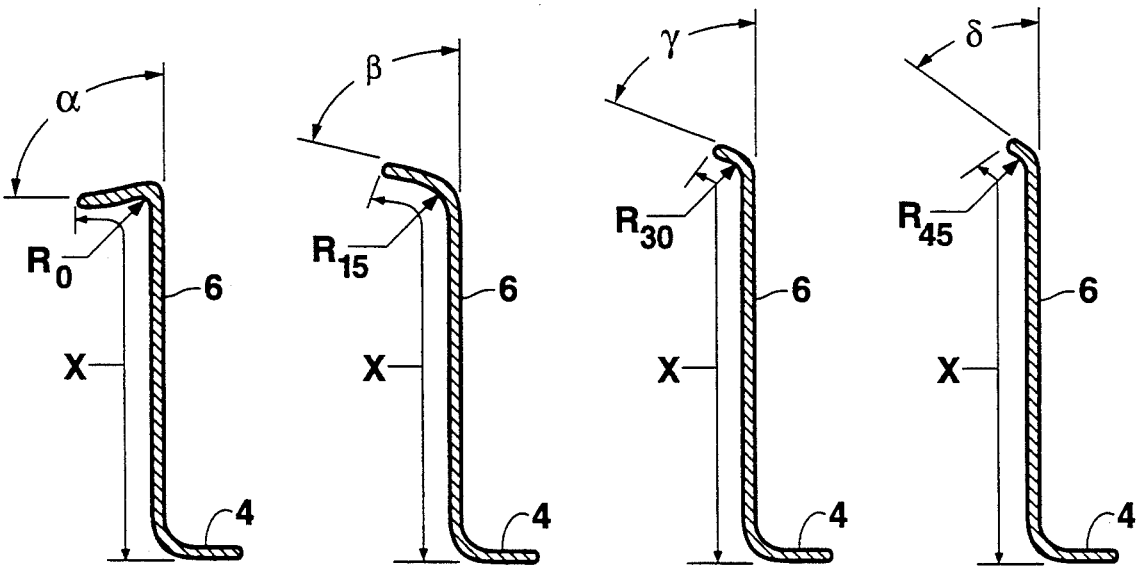
FIGS. 5*a*–5*d* are cross-sectional views of the side wall as taken along section lines 5*a*, 5*b*, 5*c*, and 5*d* as shown in FIG. 4.

Referring now to FIG. 2, a vertical center-line CL, extending from bottom 4, serves as a reference for determining the peripheral extent of pouring spout 10 along side wall 6. Turning now to FIG. 4, a top view of vessel 2, the pouring spout extends along side wall 6 for at least a 75° arc with respect to the vertical center line which is shown centrally located in vessel 2. Preferably the total arc is approximately 90° . Bisect-line BL, which is located in the approximate center of the arc occupied by the spout, depicts the peripheral center location of pouring spout 10 within the arc occupied by the pouring spout.

Referring back to FIG. 2, rim portion 8 makes a gradual transition into two opposing convex upper pouring spout surfaces 14. Preselected transition point 13, in which rim 8 makes the transition into convex upper pouring spout surfaces 14, defines the outer limits of spout 10. Opposing convex upper pouting spout surfaces 14 converge upon, and intersect with, a concave lower throat surface 16 at a preselected common tangential transition point 15. The lower most section of concave lower throat surface 16 is positioned a predetermined distance H (shown in FIG. 3) from below rim surface 8 of side wall 6. The radius of curvature of convex upper pouring spout surface 14, in the plane of FIG. 2, is depicted as R1 and thus renders the curve of surface 14 to be convex as viewed in FIG. 2. Preferably, R1 is a function of the equation:

$$R1 = 1.44D - 4.96$$

wherein R1 is the radius of curvature for surface 14, and D is the nominal inside diameter of vessels having a nominal inside diameter greater than approximately 4.5 inches.

The radius of curvature of concave lower throat surface 16 in the plane of FIG. 2 is depicted as R2 and thus renders the curve of surface 16 to be concave as viewed in FIG. 2. Preferably, R2 is a function of the equation:

$$R2=0.52D-2.11$$

wherein R2 is the radius of curvature of surface 16, and D is the nominal inside diameter of vessels having a nominal inside diameter greater than approximately 4.5 inches.

Dimension H, shown in FIG. 3, locates the lower most portion of concave lower throat surface 16 below the top of rim portion 8. Dimension H indirectly determines the location of rim to convex upper spout surface transition point 13 and convex upper spout surface—convex lower throat surface common tangential transition point 15. That is, once H is selected, the curvatures defined by R1 and R2 determine where points 13 and 15 will be located. Preferably, H is a function of the equation:

$$H=0.005D+0.516$$

wherein H is the vertical distance between the top of rim portion 8 and the lower most portion of concave lower throat surface 16, and D is the nominal inside diameter of vessels having a nominal inside diameter greater than approximately 4.5 inches. Coincidentally, the location of transition points 13 and 15 are also determinable with respect to the arc occupied by pouring spout 10 as shown in FIG. 4. Point 13, as previously defined, is located at the outer limits of pouring spout 10 on an arc having center-line CL as the center of the arc's radius. Generally, point 15 is located along that same arc at an angle approximately equal to ¼ the total angle of the arc. To illustrate, a pouring spout occupying a 90° arc will have a transition point 13 at an angle of 45° from bisect-line BL, and will have a transition point 15 at an angle of 22.5° from bisect-line BL as shown in FIG. 4.

Referring now to FIG. 2, rim 8 preferably diverges away from center-line CL, and rim 8 also preferably diverges away from an essentially vertically oriented side wall 6 by the angle δ. However, rim region 8 need not be divergent, nor does side wall 6 need to be vertical to practice the disclosed invention.

FIG. 3 is a cross-sectional view of vessel 2 taken along line B—B of FIG. 1. Pouring spout 10 includes a lip 18 which extends outwardly away from side wall 6 a length L, measured from the inside of side wall 6 to the edge of the lip. Lip 18 also has a curvature 20 that includes both horizontal and vertical components as viewed in the plane shown in FIG. 3. The vertical components of lip 18 are defined by the curvature of convex upper pouring spout surface 14, and concave lower throat surface 16, which have been previously discussed, and by a predetermined radius R which in the cross-section shown in FIG. 3 is depicted as R0. The horizontal component and length of lip 18 can best be viewed in FIG. 4 of the drawings.

The top view of vessel 2 shown in FIG. 4 shows the horizontal curvature and length of lip 18 of spout 10. The radius of curvature of the horizontal component of lip 18 in the plane shown in FIG. 4 is depicted as R3. Preferably, R3 is a function of the equation:

$$R3=0.5D-1.97$$

wherein R3 is the radius of curvature of the horizontal component of lip 18 before lip 18 gradually makes a tangential transition at a preselected point 17 to rim region 8 of side wall 6. D of the equation is the nominal inside diameter of vessels having a nominal inside diameter greater than approximately 4.5 inches.

Length L of lip 18 varies as a function of distance from bisect-line BL along the arc occupied by spout 10. Length L is at a maximum at bisect-line BL of the arc, and gradually decreases until it reaches a minimum at the point where lip 18 makes a transition to rim region 8 of side wall 6.

Selected cross-sectional views along the arc occupied by spout 10 taken at bisect-line BL at 0°, 15°, 30°, and 45°, designated as 5*a*, 5*b*, 5*c*, and 5*d*, respectively, show the variation of length of lip 18 as well as the curvature of lip 18 at various stages of transition in FIGS. 5*a*, 5*b*, 5*c*, and 5*d*. FIGS. 5*a*–5*d* thus provide a representative sampling of radius of curvature R of the bottom side of lip 18 with respect to the outside surface of side wall 6. Radius of curvature R for each section taken along the arc at 0°, 15°, 30° and 45° of the preferred embodiment are designated as R0, R15, R30, and R45, respectively, in the drawings. The selected cross-sectional views show the angle between the lower most section of lower throat surface 16 and essentially vertical side wall 6 of the preferred embodiment. Such angles are denoted as α, β, γ, and δ for the sectional views taken at 0°, 15°, 30°, and 45°, respectively, of the arc occupied by the spout as shown in FIGS. 5*a*–5*d*, respectively. However, should side wall 6 not be essentially vertical, the angle therewith should be compensated for accordingly, or alternatively measured with respect to the vertical center-line of bottom 4 to provide a suitable curvature of lip 18.

A dimension X shown in FIG. 5*a*–5*d* depicts the combined curvilinear length of wall 6 and rim 8 or lip 18, as the case may be, at a selected cross-section of the vessel. In the preferred embodiment of the invention, dimension X is of a constant value regardless of the peripheral location of dimension X with respect to vertical center-line CL. In other words, in the preferred embodiment, dimension X of annular wall 6, including rim portion 8 or lip 18, is of the same value when measured anywhere along the arc shown in FIG. 4, or any other point along the periphery of vessel 2. By maintaining X at a constant value, the cross-sectional areas of side wall 6, rim 8, and lip 18 remain essentially constant, thereby reducing possible stress concentrations in the vessel as formed. Holding dimension X at a constant value proved to be especially beneficial when fabricating the disclosed vessel from aluminum material.

A vessel having at least one pouring spout configured in accordance with the disclosed invention provides a pouring spout that will provide a stream having a cross-sectional flow pattern initially in the shape of a convex-sided V that reforms into a round, non-turbulent stream regardless of the flow rate of the liquid with any substances suspended therein being poured from the vessel. Such a stream is thus easily directed by the user as the geometry of the stream remains constant, thereby greatly aiding the user in directing the stream into receiving vessels or other receptacles. A vessel having a pouring spout configured as described also provides a pouting spout that alleviates, or significantly reduces, lapping of the stream onto the side of the vessel. Furthermore, a vessel configured as described reduces the formation of drips on and from the pouring spout after pouting from the vessel.

An example of an embodiment of the disclosed invention in the form of a cookware vessel having two identical pouting spouts opposite each other, as shown in the drawings, is set forth below:

Example of a Saucepan having a nominal 7 inch Inside Diameter 7.087 inch Inside Diameter measured ½ inch below the rim.

7.598 inch Outside Diameter measured from rim to rim.

Side wall and bottom thickness=0.098 inches
R1=5.248 inches
R2=1.575 inches
R3=1.575 inches
H=0.650 inches
D13=2.682 inches
D15=0.916 inches
L max.=0.875 inches
L min.=0.256 inches
Total Arc of spout=90°
Angle $\alpha$=90°, R0=0.382 inches
Angle $\beta$=81°, R15=0.286 inches
Angle $\gamma$=73°, R30=0.132 inches
Angle $\delta$=50°, R45=0.098 inches
Dimension X was held at a constant value The example saucepan was formed in 2 and 3 quart capacity versions having vessel heights of 4.134 inches and 5.551 inches respectively.

The above description describes the shape of the vessel's unique pour spout formed by the inventive method disclosed hereinafter. The vessel with its associated pour spout, described hereinabove, is more fully described, supra. The portion of the specification contained therein which relates to vessel and associated pour spout is hereby incorporated by reference.

Figure 6:
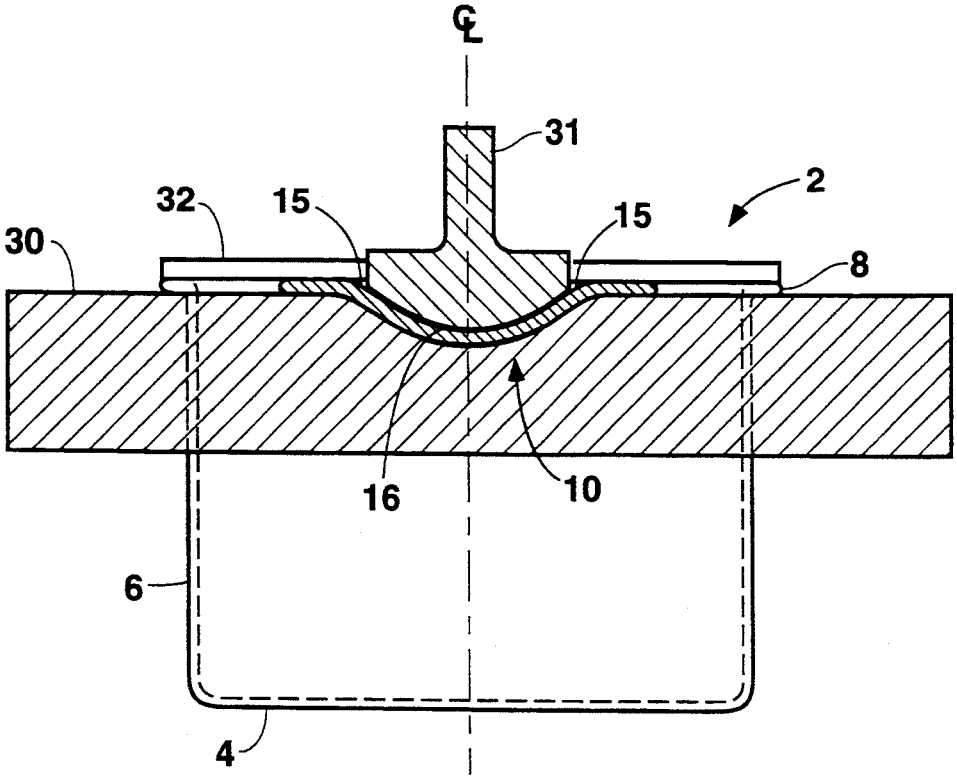
FIG. 6 is a sectional view taken along section line A—A, as shown in FIG. 1, of the cookware spout forming process at completion.
Figure 7:
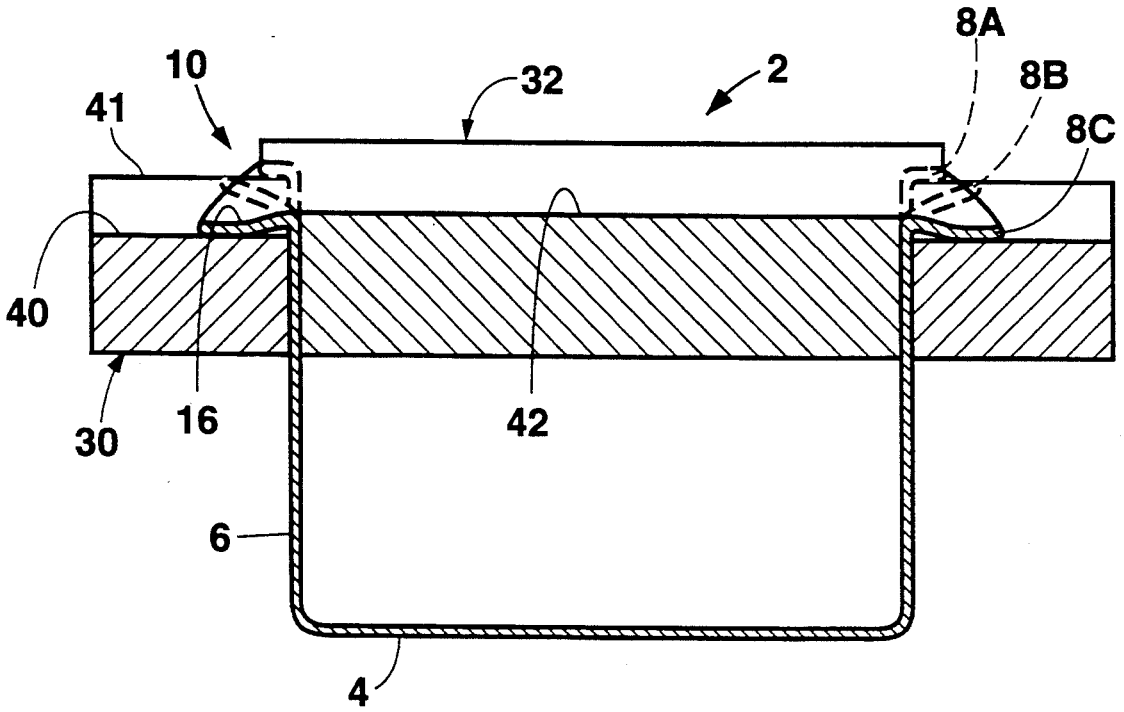
FIG. 7 is a sectional view taken along section line B—B as shown in FIG. 1, of the cookware spout forming process sequence as further embodied in FIGS. 8*a*–8*c* and 9*a*–9*c*.
Figure 8A:
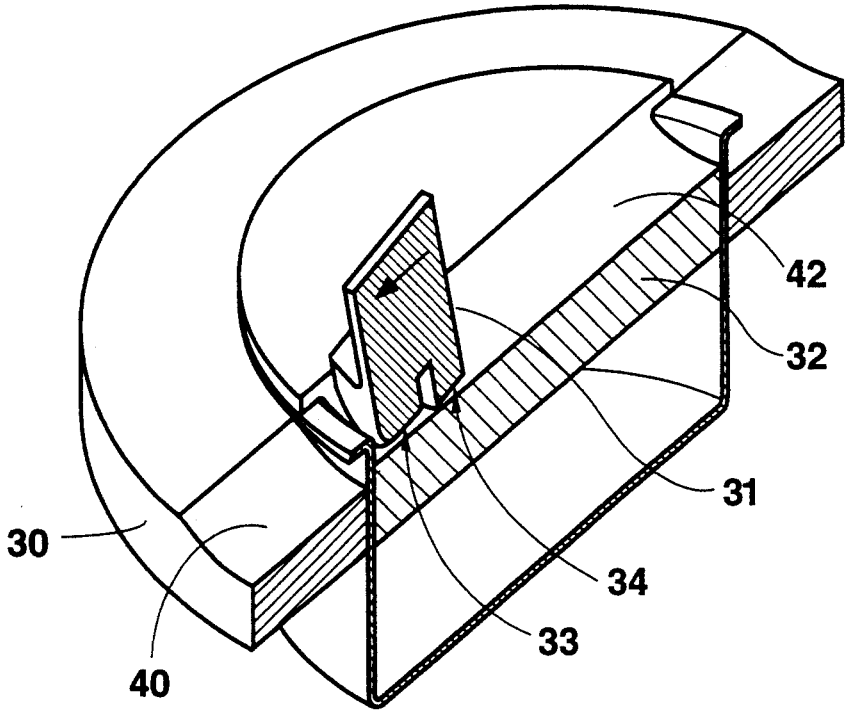
FIGS. 8*a*–8*c* are sequential perspective views of the cookware spout forming process from start to finish.
Figure 8B:
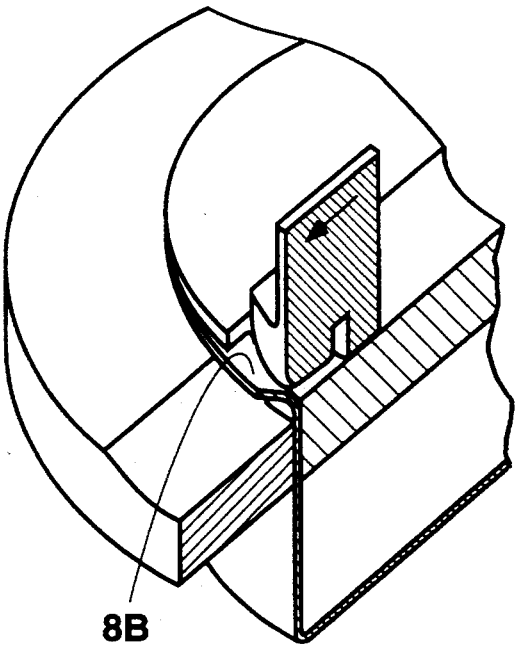
Figure 8C:
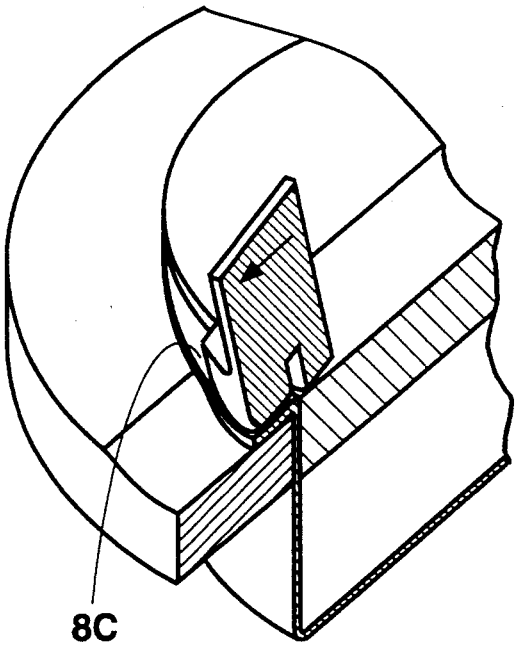

Referring now to FIGS. 6, 7 and sequential FIGS. 8*a*–8*c*, the method involves first, positioning the vessel 2 within a clamping means 30. The clamping means 30 preferably extends completely around and is in direct contact with the outside perimeter of the annular side wall 6 of vessel 2. Clamping means 30 possesses a groove 40 whose centerline forms a 90° angle with the annular side wall 6 when clamping means 30 is properly in place.

Once clamping means 30 is in place, a center plug means 32 is then placed inside vessel 2. This center plug means 32 preferably extends completely along and is in direct contact with the inner perimeter of the annular side wall 6. The center plug means possesses a radially extending groove 42 whose centerline will form a 90° angle with the annular side wall 6 when the center plug means 32 is properly in place.

Following insertion of center plug means 32, the respective groove portions' centerlines 40, 42 are aligned to form a straight line. This line will form the path of travel for pour spout forming means 31. Specifically, pour spout forming means 31 is placed in center plug portion's groove 42 and is then moved along the groove portion and into contact with rim portion 8 of vessel 6. As forming means 31 travels along the path it yieldably deforms the rim portion 8 to form the desired shape pouring spout. The means for moving forming means 31 into contact with rim portion 8 and for causing the rim portion's subsequent deformation can be supplied by any source which supplies a sufficient enough force in order to deform the rim portion. For example, a hydraulic cylinder with the sufficient force would be appropriate.

In addition to forming a path of travel for the forming means, the clamping and center plug means 30,32 provide support to annular side wall 6 during the spout forming operation. For example, if annular side wall 6 is circular, the clamping and center plug means 30,32 will limit the amount the vessel 2 is forced out of round during the pour spout forming operation.

Although the preferred embodiment describes clamping means 30 as extending completely around and in direct contact with the outside perimeter of annular side wall 6 and center plug means 32 as extending completely along and in direct contact with the inner perimeter of annular side wall 6, it is important to note that these conditions are only preferred, not required. The only size requirement that both clamping means 30 and center plug 32 means must meet is that the size must be sufficient enough such that when in place a sufficiently wide path of travel is formed in order to form the lower spout surface 16. Therefore, clamping means 30 and center plug means 32 need be no bigger than those groove portions required to form spout of the desired shape. However, it is important to note that without the respective clamping 30 and center plug 32 means to provide support it would be necessary to considerably reshape the vessel as it would have been deformed considerably from its original shape during the spout formation.

The shape of pour spout forming means 31 is critical as it possesses both a forming surface 33 and a support surface 34. The shape of forming surface 33 is such that the front portion 66 of forming surface 33 is slightly tapered. This front portion 66 transitions into the rear portion 65 which possesses a shape such that it will combine with the groove of clamping means 30 to deform rim portion 8 into the desired shape (more detailed description below). Support surface 34 provides guidance along the travel path. Additionally, forming means 31 pivots around the support surface 34 when the force direction of forming means 31 changes during the forming of the spout (see later description).

Referring now to FIGS. 8*a*–8*c* and 9*a*–9*c* wherein the forming sequence is depicted, the forming of rim portion 8 begins once forming means 31 is in contact with rim portion 8 and continues until forming means 31 forces rim portion 8 (now formed spout 10) into intimate contact with groove portion 40 of clamping means 30. In other words, when formed spout 10 is simultaneously in contact with both forming means 31 and clamping means 30, the desired shape spout will have been completely formed; a "sandwich" is formed. This intimate contact "sandwich" can be easily seen in referring to FIGS. 6 and 8C.

Generally, rim portion 8 is deformed by forming means 31 in three stages. The first stage involves deforming rim portion 8 through movement of forming means 31 in an outward and upward direction. The second stage of deformation involves yieldably deforming the rim portion as a result of an outward movement of forming means 31. The third stage of deformation involves yieldably deforming rim portion 8 as a result of an outward and downward movement of forming means 31.

Figure 9A:
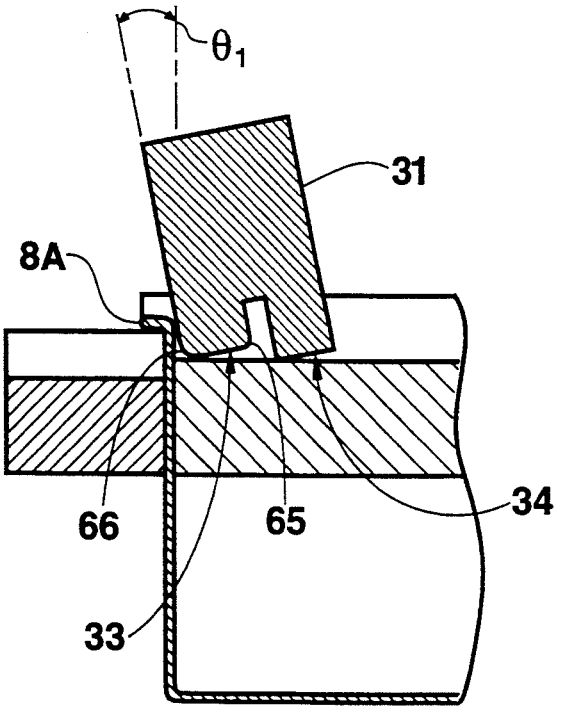
FIGS. 9*a*–9*c* are sequential sectional views taken along section line C—C as shown in FIGS. 8*a*–8*c* of the cookware spout forming process from start to finish.
Figure 9B:
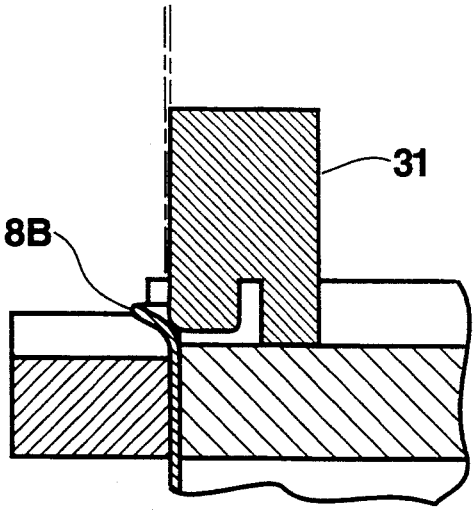

FIG. 8*a* and corresponding FIG. 9*a* depict the position of forming means 31 just prior to actual deformation of rim portion 8. The front edge 35 of forming means 31 is in contact with rim portion 8 and it forms an angle $\theta_1$ with the annular side wall ranging from >0° to 10°, preferably about 2° . In addition, both forming surface 33 and support surface 34 of forming means 3 1 are in contact with the groove portion 42 of center plug means 32. Once the above contact is made, the first stage of deformation begins as forming means 31 is moved forward along the travel path formed by the respective groove portions while at the same rime rotating upward on the support surface 34; i.e., the force of deformation is upward and outward. The forming surface 33 contact with rim portion 8 is maintained so that the rim is deformed.

At some rime during the deformation of rim portion 8, there is a transition point when forming means 31 has rotated to a point where the force or direction of deformation will contain no upward or downward component; i.e., front surface 35 of the forming means 31 and annular side wall 6 are essentially parallel to each other. It is at that point when deformation transitions from first stage to second stage deformation. The transition point rime varies from material to material and is determined through trial and error. This transition is represented in FIG. 8*b* and corresponding FIG. 9*b*.

Once the transition is made, forming means 31 continues moving along the path of travel while at the same rime maintaining this essentially parallel relationship during the entire second stage of deformation. At some point there is a transition from the second stage deformation to third stage deformation; i.e., forming means 31 begins to rotate forward and thus the direction of deformation possesses both an outward and downward component. Stated another way, forming means front surface 35 and annular side wall 6 are no longer in an essentially parallel relationship.

Figure 9C:
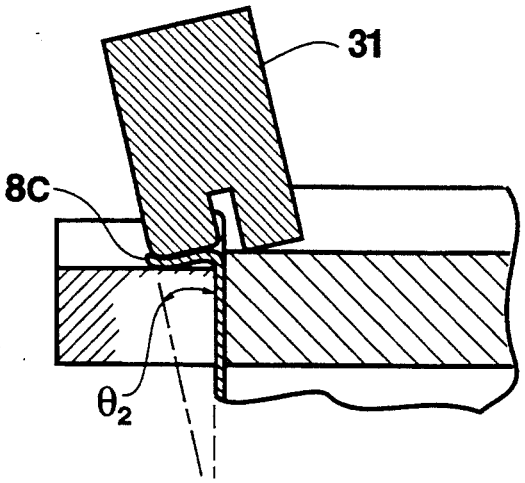

Once the transition is made, forming means 31 is moved further along the travel path to cause deformation, while at the same rime further rotating forming means 31 forward on the support means 34; i.e. the force of deformation continues downward and outward. Again, as is the case in the first stage, forming surface 33 remains in contact with rim portion 8. This stage of deformation continues until deformation is complete; i.e., until deformed rim portion 8 (now desired shape spout 10) is simultaneously in contact with both forming means 31 and clamping means; the aforementioned "sandwich". The angle $\theta_2$ formed between the front edge 35 of forming means 31 and annular side wall 6 at the completion of this stage of deformation is about between 0°-10°, preferably 0°-2°. FIG. 8*c* and corresponding FIG. 9*c* depict the position and direction of the force of forming means 31 at the end of third stage rim portion 8 deformation.

FIG. 7 shows the rim portion in its various stages of deformation. Rim portion 8A shows the rim portion just prior to deformation. Rim portion 8B shows the rim portion 8 at the transition from second stage to third stage deformation. Rim portion 8C shows the rim portion 8 at the completion of the third and last deformation; i.e., the rim has now become the pour spout.

As earlier mentioned, the shape of the forming means 31 forming surface 33 back portion should be such that it is the "mirror image" of that desired for the concave lower throat surface 16 and its associated predetermined curve profile (with both horizontal and vertical components) lip 18 which extends outwardly away frown the side wall. The shape of the clamping means groove portion 40 is critical and possesses the same shape as that desired for lower throat surface 16. Additionally, the groove 40 should be of such depth, shape and position along annular side wall 6 that, when rim portion 8 is deformed into contact with the groove 40, the spout formed will be of the desired predetermined distance H below rim portion 8 of side wall 6. It follows that, if the groove is such that the predetermined distance H is obtained, the predetermined varying length lip portion 18 associated with the lower throat surface (as earlier described) will be obtained.

If forming surface 35 and clamping means groove portion 40 are of the proper shape and combine to form lower throat surface portion 16 and the lip portions 18 associated therewith into the desired shape, the rest of the pour spout, i.e., the convex surfaces 13 and the lip portions 18 associated therewith, will automatically be deformed into the desired shape. Thus the desired-shape pour spout 10 will be formed.

Figure 10:
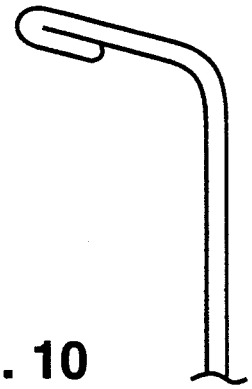
FIG. 10 is cross-sectional view of the rim portion in its crimped form.

The force of forming means 31 needed to properly form the pour spout will vary from material to material. It will also vary as rim portions vary from vessel type to vessel type. In other words, the direction of the force of forming means 31 and the rate of travel of the forming means, i.e., the force, will vary from material to material and from rim portion thickness to rim portion thickness. For instance, in some vessels the rim portion 8 may be provided with a crimped top edge as shown in FIG. 10. It is self-evident that a rim portion that is crimped will require a greater force of deformation than a non-crimped rim portion of the same material. It is only through trial and error that the right combination of directional forces and rate of travel can be found in order to form the desired shape pour spout without causing the material to buckle. Such experimentation, however, is well within the skill of the metal worker. Once the proper variables are set for a specific material they can be controlled through the use of a means for movement, coupled with a directional guide means such as a cam system (neither is shown in the drawings), attached to forming means 31.

EXAMPLE

The following variables were obtained when forming a spout in a 304 Series stainless steel vessel having a inside diameter of 7.027 in. and a crimped rim portion with an annular side wall thickness of 0.025 in. and with the movement being supplied by a hand pumped hydraulic press:

Movement means force—800-3000 psi (1700-1800-preferred);
Time of deformation—approximately 10 secs.
first stage—approx. 2 secs.
second stage—approx. 6 secs.
third stage—approx. 2 secs.;
$\theta_1=2°$; and
$\theta_2=2°$. Although the above method was developed for use with stainless steel and the example variables were obtained for the same material, it is contemplated that the method would be suitable for any material which can be yieldably deformed. Furthermore, it would be obvious to one skilled in the art that the amount of force required would change if the movement was supplied by continuous hydraulic pump or any other force means.

We claim:

1. A method for forming a constant geometry and non-turbulent stream inducing pouring spout in the rim of an annular side-walled vessel comprising the steps of:

a) positioning the vessel within a clamp possessing a groove, the centerline of the groove forming a 90° angle with the annular side wall of the vessel when the clamp is in place;

b) placing inside the vessel a center plug possessing a radially extending groove, the centerline of the groove forming a 90° angle with the annular side wall when the center plug is in place;

c) aligning the respective grooves' centerlines resulting in a straight line travel path;

d) placing a pour spout former in the center plug groove and causing the spout former to move along the travel path and into contact with the rim of the vessel, and, e) further causing the former to move along the travel path thereby yieldably deforming the rim of the annular wall within the clamp groove into a pouting spout of a desired shape.

2. The method as claimed in claim 1 wherein the clamp extends completely around and is in direct contact with the outside perimeter of the annular side wall.

3. The method as claimed in claim 1 wherein the center plug extends completely along and is in direct contact with the inner perimeter of the annular side wall.

4. The method as claimed in claim 1 wherein the rim is deformed in three stages, a first stage involving deformation of the rim by the former in an outward and upward force; a second stage involving deformation of the rim by the former in an outward force; and a third stage involving deformation of the rim by the former in an outward and downward force.

5. The method as claimed in claim 1 wherein the rim is deformed until the rim is simultaneously in intimate contact with both the former and the clamp.

* * * * *